US010151194B2

(12) United States Patent
Roth et al.

(10) Patent No.: US 10,151,194 B2
(45) Date of Patent: Dec. 11, 2018

(54) ELECTRICAL SUBMERSIBLE PUMP WITH PROXIMITY SENSOR

(71) Applicant: Saudi Arabian Oil Company, Dhahran (SA)

(72) Inventors: Brian A. Roth, Dhahran (SA); Jinjiang Xiao, Dhahran (SA)

(73) Assignee: SAUDI ARABIAN OIL COMPANY (SA)

( * ) Notice: Subject to any disclaimer, the term of this patent is extended or adjusted under 35 U.S.C. 154(b) by 218 days.

(21) Appl. No.: 15/196,696

(22) Filed: Jun. 29, 2016

(65) Prior Publication Data

US 2018/0003034 A1 Jan. 4, 2018

(51) Int. Cl.
*E21B 47/09* (2012.01)
*E21B 43/12* (2006.01)

(52) U.S. Cl.
CPC ..... *E21B 47/09* (2013.01); *E21B 43/128* (2013.01)

(58) Field of Classification Search
CPC ..... E21B 47/09; E21B 43/128; E21B 23/01; E21B 23/00; E21B 33/0385; F04B 47/00
See application file for complete search history.

(56) References Cited

U.S. PATENT DOCUMENTS

| | | | | |
|---|---|---|---|---|
| 6,000,468 | A | 12/1999 | Pringle | |
| 6,328,111 | B1 | 12/2001 | Bearden et al. | |
| 6,359,569 | B2 | 3/2002 | Beck et al. | |
| 7,385,523 | B2 | 6/2008 | Thomeer et al. | |
| 7,413,011 | B1 * | 8/2008 | Chee | G01R 33/0322 166/250.01 |
| 7,503,398 | B2 | 3/2009 | LoGiudice et al. | |
| 7,874,352 | B2 | 1/2011 | Odell, II et al. | |
| 8,056,619 | B2 | 11/2011 | Patel et al. | |
| 8,567,512 | B2 | 10/2013 | Odell, II et al. | |
| 8,866,632 | B2 | 10/2014 | Hrametz et al. | |
| 2006/0243450 | A1 * | 11/2006 | Head | E21B 17/026 166/369 |
| 2009/0034368 | A1 | 2/2009 | Johnson | |
| 2009/0242212 | A1 * | 10/2009 | Shaw | E21B 17/028 166/378 |

(Continued)

FOREIGN PATENT DOCUMENTS

| | | | |
|---|---|---|---|
| WO | 2014105007 | A1 | 7/2014 |
| WO | 2014186221 | A1 | 11/2014 |
| WO | 2016171667 | A1 | 10/2016 |

OTHER PUBLICATIONS

The International Search Report and Written Opinion for related PCT application PCT/US2017/039412 dated Sep. 27, 2017.

*Primary Examiner* — Michael R Wills, III
(74) *Attorney, Agent, or Firm* — Bracewell LLP; Constance Gall Rhebergen

(57) ABSTRACT

A system and method for producing fluid from a subterranean wellbore that includes an electrical submersible pump ("ESP") system and a receptacle. The ESP system is landed in the receptacle while sensing the presence of the ESP system with respect to the receptacle. The ESP system includes a motor, a pump, a monitoring sub, and a stinger on the lower end of the pump. A sensor on the receptacle detects the position of the stinger within the receptacle, and provides an indication that the stinger has inserted a designated length into the receptacle so that a fluid tight seal is formed between the stinger and receptacle.

20 Claims, 4 Drawing Sheets

(56) References Cited

U.S. PATENT DOCUMENTS

| | | | | |
|---|---|---|---|---|
| 2011/0030972 | A1* | 2/2011 | Brookbank | E21B 17/028 166/381 |
| 2012/0181043 | A1* | 7/2012 | Patel | E21B 43/128 166/373 |
| 2012/0222853 | A1* | 9/2012 | Head | E21B 17/028 166/65.1 |
| 2013/0043019 | A1* | 2/2013 | Hansen | E21B 17/028 166/65.1 |
| 2013/0062050 | A1* | 3/2013 | Head | E21B 17/028 166/105 |
| 2013/0272906 | A1* | 10/2013 | Head | E21B 17/206 417/410.1 |
| 2014/0000864 | A1 | 1/2014 | Fielder, III et al. | |
| 2014/0116686 | A1 | 5/2014 | Odell, II et al. | |
| 2014/0158380 | A1* | 6/2014 | Varkey | E21B 33/08 166/386 |
| 2015/0354288 | A1* | 12/2015 | Kobersky | E21B 23/02 166/382 |
| 2017/0268328 | A1 | 9/2017 | Kharal et al. | |

* cited by examiner

ELECTRICAL SUBMERSIBLE PUMP WITH PROXIMITY SENSOR

BACKGROUND OF THE INVENTION

1. Field of Invention

The present disclosure relates to a system and method of producing hydrocarbons from a subterranean wellbore. More specifically, the present disclosure relates to using sensors to confirm an electrical submersible pumping system is landed in a designated position in a receptacle.

2. Description of Prior Art

Electrical submersible pump ("ESP") systems are sometimes deployed in a wellbore when pressure of production fluids in the wellbore is insufficient for natural production. A typical ESP system is made up of a pump for pressurizing the production fluids, a motor for driving the pump, and a seal system for equalizing pressure in the ESP with ambient. Production fluid pressurized by the ESP systems is typically discharged into a string of tubing or pipe known as a production string; which conveys the pressurized production fluid up the wellbore to a wellhead assembly.

Some ESP assemblies are suspended on an end of the production tubing and within casing that lines the wellbore. Other ESP systems are inserted within production tubing, where a packer between the ESP and tubing inner surface provides a pressure barrier between the pump inlet and discharge ports of the pump. Some of the in tubing ESP systems are equipped with an elongated stinger on their lower ends that inserts into a bore receptacle formed within the tubing. A seal on generally provided on the stinger to create a sealing flow barrier between the stinger and a bore in the receptacle. A cable weight indicator is sometimes used when lowering ESP systems into a wellbore on cable, and which reflects tension in the cable. A drop in cable tension can be a sign that the ESP system has landed in the receptacle, and that a seal has formed between the stinger and bore. Landing is sometimes also confirmed by a measure of the how much cable has been fed into the wellbore, which can indicate the depth of the ESP system in the wellbore.

However, sometimes an ESP system may not land properly, and yet a designated drop in cable tension and depth can be observed. An improper landing can prevent the stinger from sealing in the seal bore receptacle, which could lead to inefficient pump rates or no flow to surface due to recirculation of the fluid from the pump discharge to the pump intake. Additionally, the stinger in the receptacle can move upward and downward because of thermal changes of the cable due to heating and cooling of the production fluid in the wellbore, which can occur during shut in, while producing, or during treatment. Upward movement of the stinger seal assembly could cause the stinger to come out of the seal bore receptacle if there is insufficient stroke travel of the stinger in the receptacle.

SUMMARY OF THE INVENTION

Disclosed herein is an example of a system for producing fluid from a subterranean wellbore that includes an electrical submersible pump ("ESP") system having a pump, a motor mechanically coupled with the pump, a monitoring sub, and a stinger projecting axially away from the pump. The system also includes a receptacle with an annular member mounted to a tubular disposed in the wellbore, and a sensor that selectively emits a signal representing a distance between the stinger and receptacle. The sensor can be a casing collar locator. In an example, the sensor is a first sensor that couples with the stinger, the system further having a second sensor with the stinger. Optionally, the sensor can be a multiplicity of sensors. Example sensors include an optical sensor, an acoustic sensor, an electromagnetic sensor, a permanent magnet, and combinations thereof. A controller can be included with the system that is in communication with the sensor that identifies when a distance between the stinger and the receptacle is at around a designated distance, thereby indicating the stinger is landed in the receptacle. The system can also include a reel, a cable on the reel having an end coupled to the ESP, and a load sensor on the reel that senses tension in the cable and that is in communication with the controller. The system can also include a seal that defines a flow and pressure barrier in an annulus between the stinger and receptacle and that is formed when the stinger inserts into the receptacle. In one example, the signal is different from a signal that is emitted from the sensor when the stinger is adjacent to and outside of the receptacle. In one alternative, the monitoring sub is in communication with the sensor and in communication with a controller that is outside of the wellbore.

Also described herein is a method for producing fluid from a subterranean wellbore that includes deploying in the wellbore an electrical submersible pumping ("ESP") system that has a motor that is coupled to a pump, lowering the ESP system within the wellbore and towards a receptacle, sensing a distance between a location on the ESP system and a location in the receptacle, and pressurizing fluid within the wellbore with the pump when the distance between the end of the ESP system and receptacle is within a designated distance. The sensing location on the ESP system can be on a stinger that projects axially away from the pump. Sensing a distance between a location on the ESP system and a location in the receptacle can include monitoring signals from a sensor coupled with the stinger, wherein the sensor senses the presence of the receptacle. Alternatively, sensing a distance between a location on the ESP system and a location in the receptacle involves monitoring signals from a sensor coupled with the receptacle, wherein the sensor senses the presence of the stinger. Optionally, sensing a distance between a location on the ESP system and a location in the receptacle includes monitoring signals from sensors that are coupled with the stinger or the receptacle, and wherein the sensors can sense the presence of the receptacle or the stinger. Further optionally, sensing a distance between a location on the ESP system and a location in the receptacle includes monitoring signals from a sensor coupled with the stinger, wherein the sensor senses the presence of a sensor coupled with the receptacle. The method can also include sensing a load on a conveyance means used to deploy the ESP system. The ESP system can optionally be lowered on a wireline, in this example the method further includes monitoring stress in the wireline.

BRIEF DESCRIPTION OF DRAWINGS

Some of the features and benefits of the present invention having been stated, others will become apparent as the description proceeds when taken in conjunction with the accompanying drawings, in which.

Figure 1:
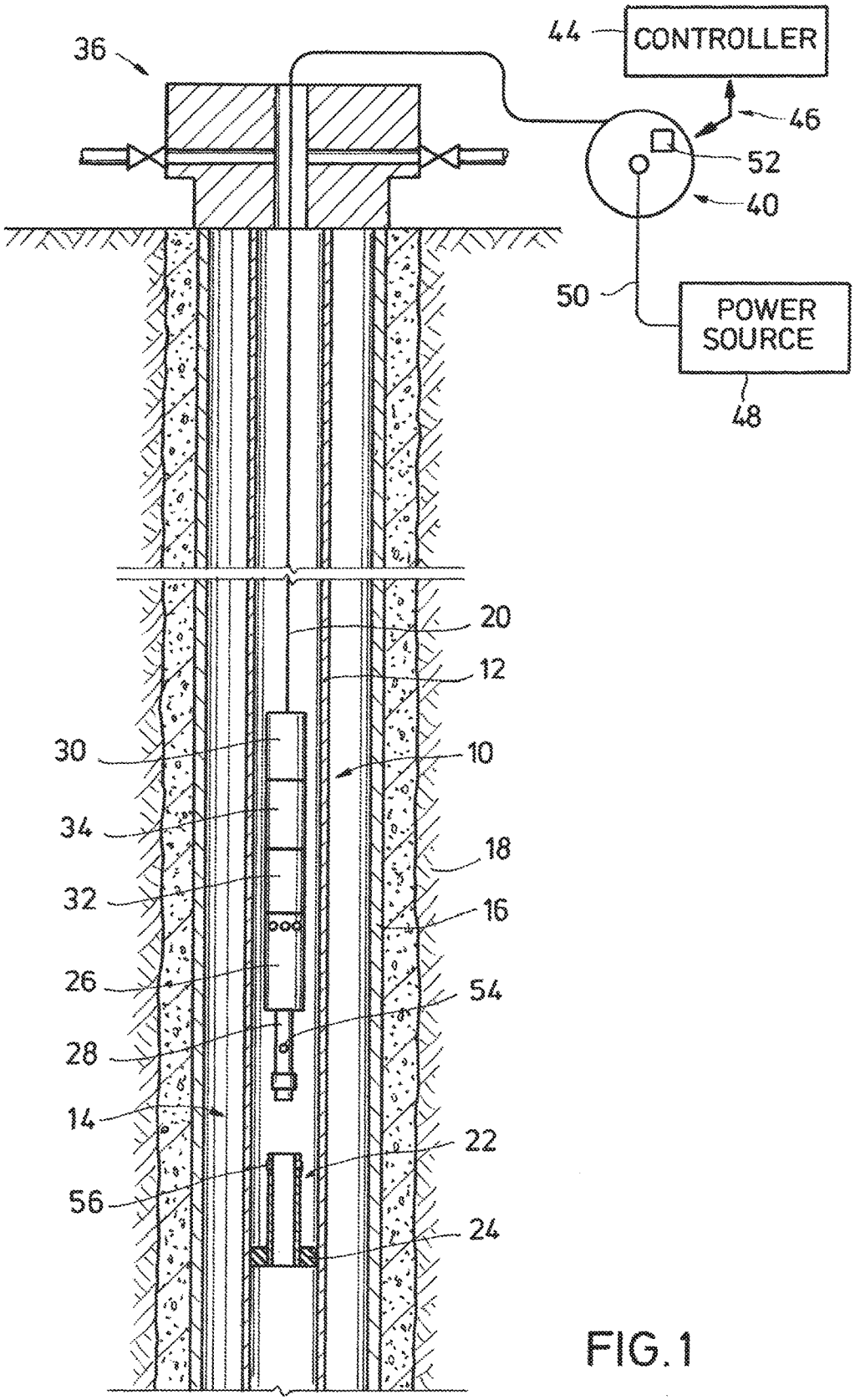
FIG. 1 is a side partial sectional view of an example of an ESP system being lowered in a wellbore.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Shown in FIG. 1 is one example of an electrical submersible pumping ("ESP") system 10 being lowered within production tubing 12 shown axially disposed within a wellbore 14. Wellbore 14 is lined with casing 16 that is cemented against a formation 18 that circumscribes wellbore 14. In the example of FIG. 1, the ESP system 10 is being landed by cable 20 into a receptacle 22; where receptacle 22 is anchored to the inside of production tubing 12. A packer 24 is provided in the annular space between receptacle 22 and tubing 12 and defines a pressure and fluid flow barrier between receptacle 22 and tubing 12.

An example of a pump 26 is schematically depicted with the ESP system 10 which provides a means for pressurizing fluid produced within wellbore 14 so that the fluid can be conveyed to surface. Pump 26 can be centrifugal with impellers and diffusers within (not shown), a progressive cavity pump, or any other device for lifting fluid from a wellbore. An elongated stinger 28 is shown depending coaxially downward from the lower end of pump 26. On the end of ESP system 10 opposite from stinger 28 is a motor 30, which can be powered by electricity conducted within cable 20. Motor 30 is mechanically coupled to pump 26 by a shaft (not shown) and which drives pump 26. A monitoring sub 32 shown on an upper end of pump 26. An optional seal 34 shown disposed between the monitoring sub 32 and motor 30. In one example, seal 34 contains dielectric fluid that is communicated into motor 30 for equalizing the inside of motor 30 with ambient pressure.

A wellhead assembly 36 is shown anchored at an opening of wellbore 14 and on surface. An upper end of cable 20 routes through a passage 38 in wellhead assembly 36 and winds onto a reel 40. Selectively rotating reel 20 can raise or lower ESP system 10 within wellbore 14. Shown at the opening of passage 38, is an example of a packoff 42 that seals and occupies the annular space between cable 20 and passage 38; and is allows movement of cable through passage 38. Further shown on surface is a controller 44 which is in communication with reel 40 and cable 20 via a communication means 46. The communication means 46 can be hard wired or wireless, and that can provide communication between controller 44 and components within the ESP system 10. Thus, control and monitoring of the ESP system 10 can take place remotely and outside of wellbore 14. Shown outside of wellhead assembly 36 is a power source 48 that connects to reel 40 via line 50. Where source 48 provides electrical power for use by ESP system 10, examples of source 48 include a local utility, or an onsite power generator. Optionally included within power source 48 is a variable frequency drive for conditioning the electricity prior to being transmitted via cable 20 to motor 30. Also shown on reel 40 is a schematic example of a load sensor 52, which includes a means for measuring tension within cable 20 during wellbore operations. As shown cable 20 provides an example of a conveyance means for raising and lowering the ESP system 10 within the wellbore 14 can, other such conveyance means include coiled tubing, cable, slickline and the like.

Controller 44 may also be in communication, such as via communication means 46, with a proximity sensor 54 shown mounted onto stinger 28. In one example, proximity sensor 54 can detect the presence of tubulars, such as the receptacle 22. Optionally, another proximity sensor 56 is shown provided with the receptacle 22, and which is also in communication with the controller 44. Examples of proximity sensors include capacitive, magnetic, inductive, hall effect, optical, acoustic, electromagnetic, permanent magnets, and combinations thereof. In one embodiment one or more of the proximity sensors include a casing collar locator, such as permanent magnets in combination with an electrically conducting coil. Power for the proximity sensors 54, 56 can be from a battery, the line 50, or from energy harvesting. In one example, proximity sensor 54, 56 transmits either via hardwire or wireless to a communication system included within monitoring sub 32; which is in communication with controller 44 via communication signals in cable 20. As discussed above, cable 20 is in communication with controller 44 via communication means 46. Thus by monitoring signals received from one or both of the proximity sensors 54, 56, such as via a monitor (not shown) communicatively coupled with controller 44, an indication can be provided to operations personnel controlling ESP system 10 of when the stinger 28 inserts into receptacle 22.

Figure 2:
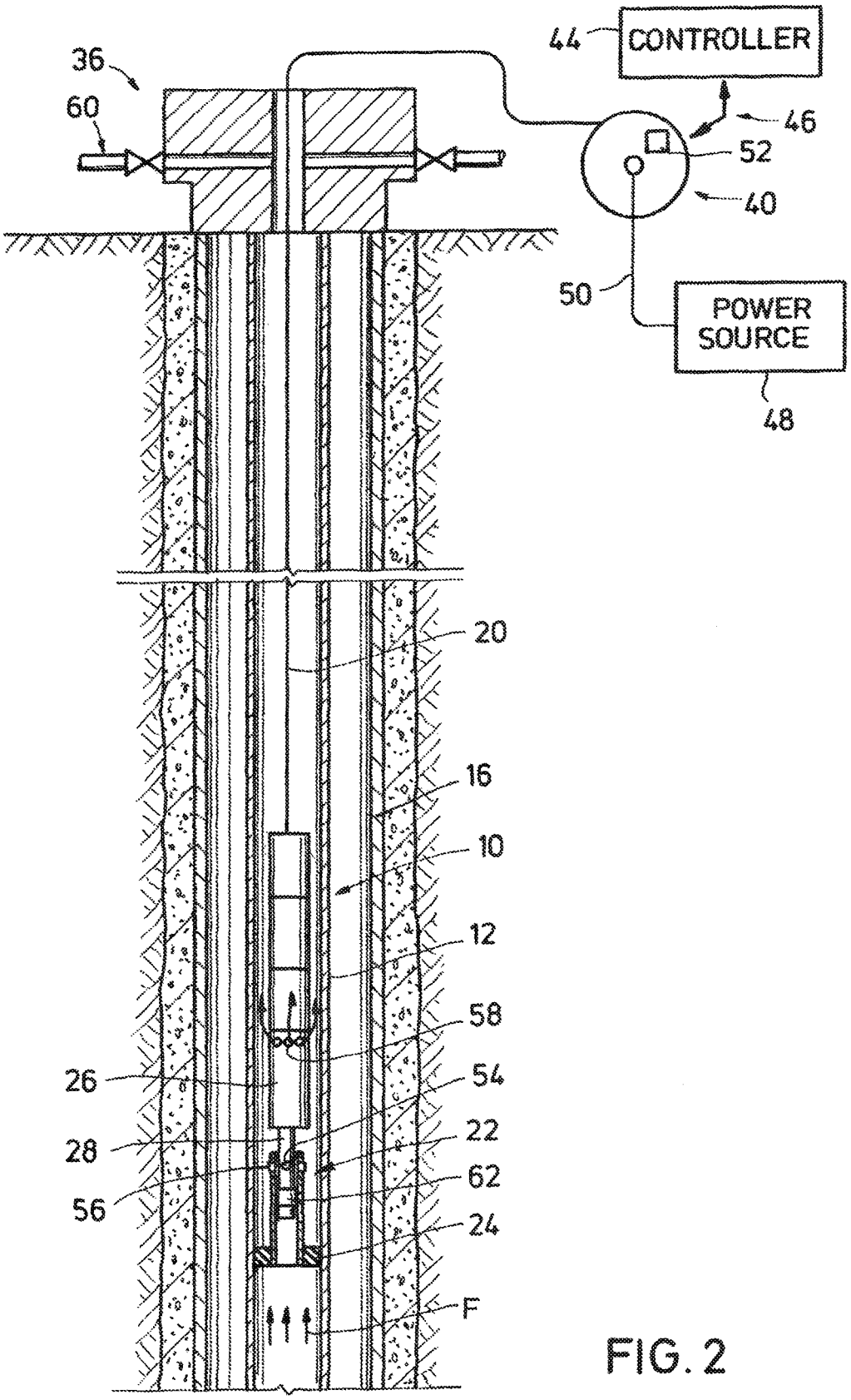
FIG. 2 is a side partial sectional view of an example of an ESP system landed within production tubing.

Referring now to FIG. 2, shown as one example of the ESP system 10 landing within receptacle 22. As discussed above, in the illustrated example monitoring signals from one or more of the proximity sensors 54, 56 provide an indication that the stinger 28 has inserted into the receptacle 22. Landing of the ESP system 10, or stinger 28, can be identified when the signal or signals from sensor 54, sensor 56, or both, indicates that the stinger 28 has been inserted into receptacle 22 a designated distance. The designated distance can depend on the specific design of the stinger 28 and receptacle 22, and it will be appreciated that those skilled in the art can establish a designated distance depending on the design of the stinger 28 and receptacle 22. In an embodiment, signals emitted from proximity sensors 54, 56 when stinger 28 lands in receptacle 22 are distinguishable from signals emitted by proximity sensors 54, 56 when stinger 28 is adjacent to, but outside of receptacle 22. In an example, proximity sensor 54 is on the outer surface of stinger 28, and proximity sensor 56 is on the inner surface of receptacle 22. When it is confirmed that stinger 28 has landed into receptacle 22 so that a fluid seal is formed between stinger 28 and receptacle 22, operation of ESP system 10 can commence by energizing motor 30 so that pump 26 can begin to draw fluid from within wellbore 14. In one example of operation, monitoring signals from proximity sensors 54, 56 can not only provide distances between a one of the sensors 54, 56 and the stinger 28 and/or receptacle 22, but also locations on the stinger 28 or receptacle 22. For example, knowing where on the stinger 28 or receptacle 22 the sensors 54, 56 are disposed, when the sensors 54, 56 detect the distance between it and the other proximity sensor 54, 56 or the stinger 28 and receptacle 22, a distance between any location on the stinger 28 to any location on the receptacle 22 can be determined. Example locations on the stinger 28 or receptacle 22, can be where the sensors 54, 56 are mounted, or the lower and upper terminal ends of the stinger 28 and receptacle 22.

As shown, fluid F is flowing within production tubing 12 and upstream of receptacle 22. Packer 24 blocks flow of fluid F from entering the annulus between receptacle 22 and tubing 12 and forces flow of fluid F into the receptacle 22 and towards stinger 28. After flowing through stinger 28 the fluid F is drawn into pump 26 where it is pressurized and discharged from discharge ports 58 into the production tubing 12 above packers 24. Pressurized fluid exiting ports 58 is then directed upward within tubing 12 to wellhead assembly 36. A main bore within well head assembly 36 directs the produced fluid into a production flow line 60 where the fluid can then be distributed to storage or to a processing facility (not shown).

In addition to providing an indication of when the stinger 28 lands into sealing contact with the receptacle 22, another advantage of proximity sensors 54, 56 is that the position of the stinger 28 with respect to the receptacle 22 can be monitored during production. For example, due to temperature changes in the wellbore 14, the cable 20 may constrict thereby drawing the ESP system 10 upward and away from receptacle 22. However, constant monitoring of signals from one or both of the proximity sensors 54, 56, such as through monitor 44 can detect relative movement of the stinger 28 and receptacle 22 and provide an indication if the ESP system 10 is properly or improperly seated within receptacle 22. Knowledge of an improperly seated ESP system 10 (i.e. the stinger 28 inserted into the receptacle 22 so that a seal is not formed between the two), and correcting the seating of the ESP 10 if it is improper, can thereby ensure a leak free flow of fluid. Additionally, thrust of the pump 26 may also be estimated by monitoring the proximity sensors 54, 56; as well as an estimate of stress on the line 50, i.e. is it increasing or decreasing. Further shown in FIG. 2 is a seal 62 provided on stinger 28 and for providing a pressure and flow barrier in the space between the outer surface of stinger 28 and inner surface of receptacle 22, thereby forcing all of the flow of fluid F into the stinger 28. Sensors 54, 56 can be passive or active.

Figure 3B:
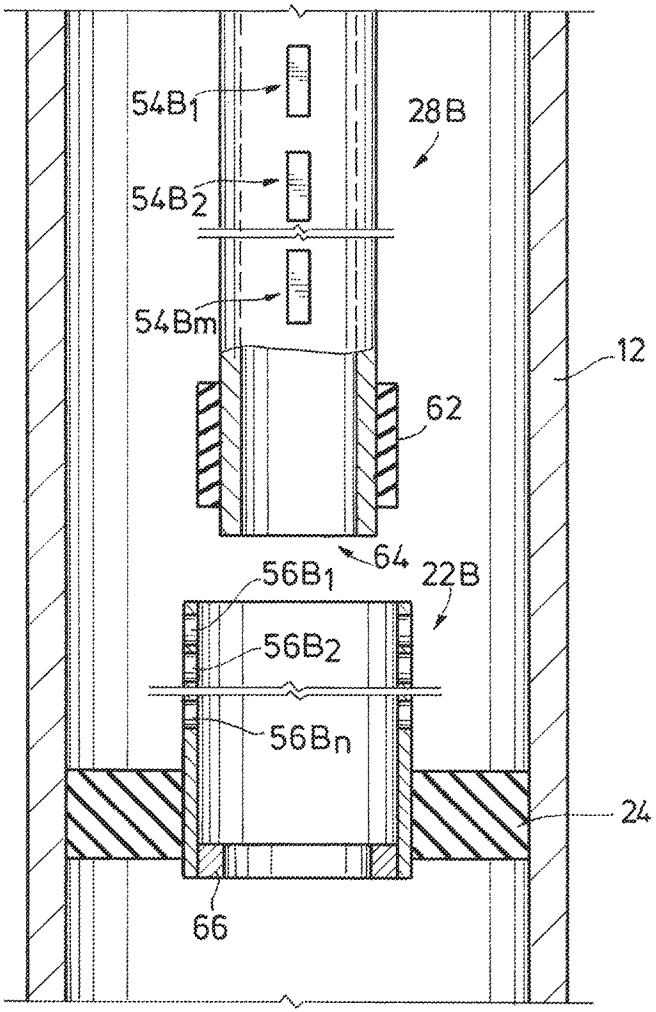
FIG. 3B is a side partial sectional view of an alternate embodiment of the seal bore receptacle of FIG. 3A.
Figure 3A:
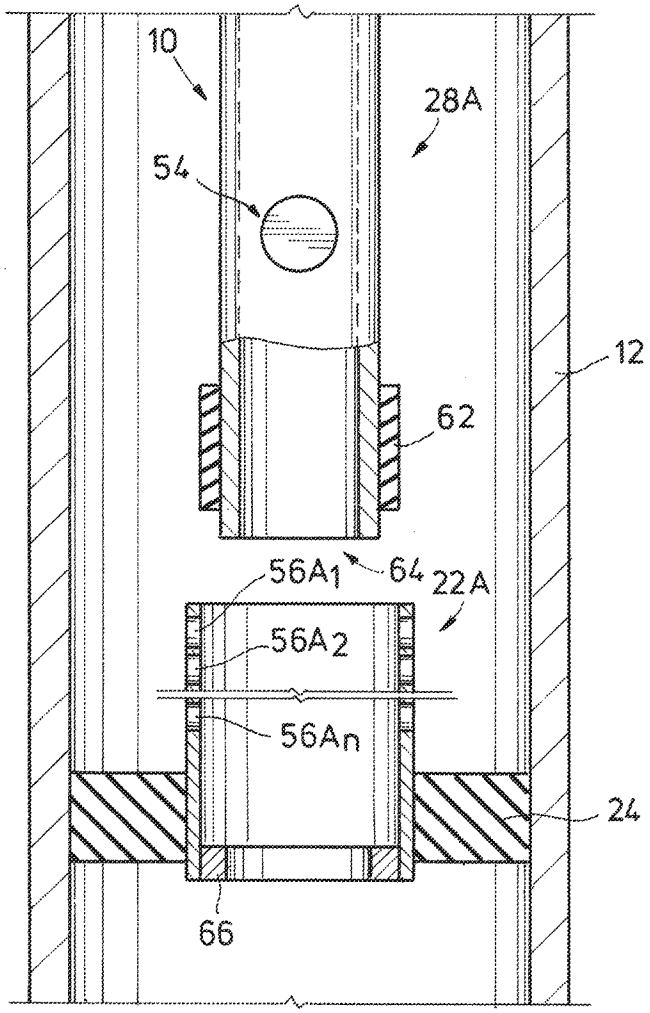
FIG. 3A is a side partial sectional views of an embodiment of a seal bore receptacle for use with the production tubing of FIG. 2.

Shown in FIG. 3A is an alternate embodiment of the receptacle 22A wherein multiple proximity sensors 56$A_1$-56$A_n$ are shown within the sidewall of the tubular portion of receptacle 22A. Further illustrated in dashed outline, is a bore 64 that extends axially within stinger 28A and provides a flow path for the flow of fluid F (FIG. 2) to make its way to an inlet port of the pump 26. In the example of FIG. 3A, the multiple proximity sensors 56$A_1$-56$A_n$, are axially spaced apart from one another within the sidewall of the receptacle 22A. However, embodiments exist wherein the sensors 56$A_1$-56$A_n$ are either wholly on the inner surface, or on the outer surface of receptacle 22A. As such, as the stinger 28A is inserted within receptacle 22A, multiple signals may be monitored by the controller 44 (FIG. 2) as the proximity sensor 54 passes by proximity sensors 56$A_1$-56$A_n$. Further shown in FIG. 3A is an optional landing 66 which provides a support for the lower end of stinger 28 and which can axially retain ESP system 10 within tubing 12.

FIG. 3B shows an alternate embodiment of the stinger 28B wherein multiple proximity sensors 54$B_1$-54$B_m$, are provided with the stinger 28B. In the embodiment of FIG. 3B, the sensors 56$B_1$-56$B_n$, are also included with receptacle 22B. As indicated above, in one non-limiting example one or more signals are generated by sensors 54$B_1$-54$B_m$, in response to detecting the proximity of sensors 56$B_1$-56$B_n$, or vice versa. Optionally signals are generated when sensors 54$B_1$-54$B_m$, or sensors 56$B_1$-56$B_m$, are in proximity with a mass of material, such as receptacle 22B or stinger 28B. Thus, multiple signals may be generated and/or monitored as the stinger 28B is inserted within receptacle 22B, thereby providing a substantially discrete observation of the relative positions of the stinger 28B with receptacle 22B, from which the length of the stinger 28B can be measured that is inserted into receptacle 22B. In one example, sensors 54$B_1$-54$B_m$, and/or sensors 56$B_1$-56$B_n$ are spaced axially equidistant from one another, such as for example increments of around 1.0 feet between adjacent ones of sensors 54$B_1$-54$B_m$, and/or sensors 56$B_1$-56$B_n$. Alternative spacing between adjacent sensors 54$B_1$-54$B_n$, and/or sensors 56$B_1$-56$B_n$, include around 1.0 inches, 6.0 inches, and all other distances between 1.0 inches to around 12 inches. Optionally, sensors 54$B_1$-54$B_m$, and/or sensors 56$B_1$-56$B_n$, are axially spaced apart from one another at different distances, in this example staggered signals from the differently spaced apart sensors 54$B_1$-54$B_m$, and/or sensors 56$B_1$-56$B_n$ can indicate which relative positions of sensors 54$B_1$-54$B_m$, and/or sensors 56$B_1$-56$B_n$, thereby providing discrete indications of the relative positions of the stinger 28B and the receptacle 22B. In one alternative, the detectable distance that sensors 54$B_1$-54$B_m$, and/or sensors 56$B_1$-56$B_n$, can sense one another or a designated object ranges from around 0.062 inches to around 3.000 inches, and wherein the sensitivity can be around 0.250 inches. Embodiments exist wherein a one of the stinger 28 or receptacle 22 have a single sensor and the other of the stinger 28 or receptacle 22 have multiple sensors. Yet an additional embodiment exists wherein a one of the stinger 28 or receptacle 22 have a single sensor or multiple sensors, and the other of the stinger 28 or receptacle 22 have no sensors. In this example, the component having the single or multiple sensors detects the presence of the other component, such as that done by a collar casing locator.

Figure 4:
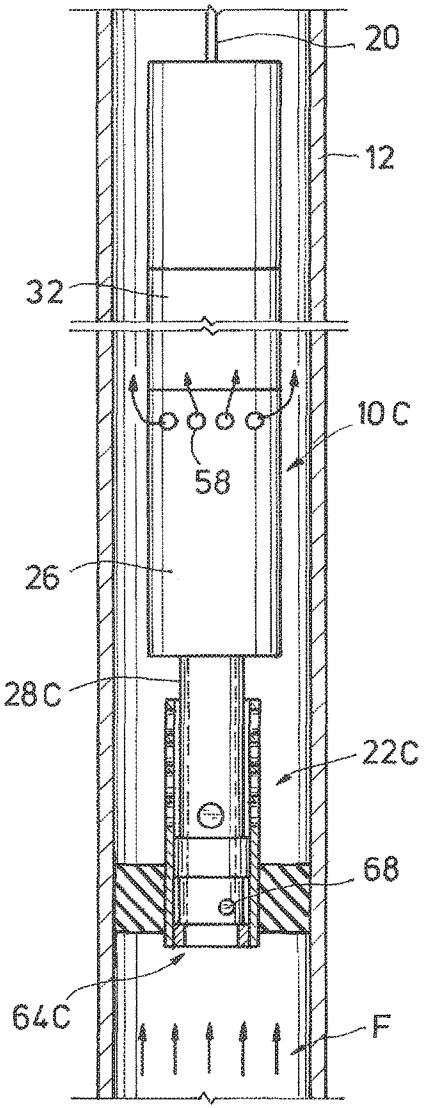
FIG. 4 is a side partial sectional view of an alternate example of the ESP system of FIG. 1.

FIG. 4, shows in a side partial sectional view another example of the ESP system 10C being landed within a receptacle 22C within the tubing 12, and producing fluid F from within production tubing 12. In this example, a pressure sensor 68 is provided on a lower most end of the stinger 28C and proximate an opening of bore 64C. As such, monitoring of pressure sensor 68 can provide an indication of the pressure of fluid F as it flows into receptacle 28C. Similar to the other sensors described herein, pressure sensor 68 can be in communication with monitoring sub 32, via hard wire, fiber optic and the like, or by wireless communication. Thus conditions sensed by pressure sensor 68 can be transmitted uphole and to controller 44 via monitoring sub 32, cable, 20, and communication means 46. Additional sensors may be included with system 10C, such as for pressure at the inlet and outlet of pump 26, temperature and voltage of motor 30 (FIG. 1), temperature and viscosity of fluid in wellbore 14, and other fluid conditions and which may be connected to circuitry provided within the monitoring sub 32.

Figure 5:
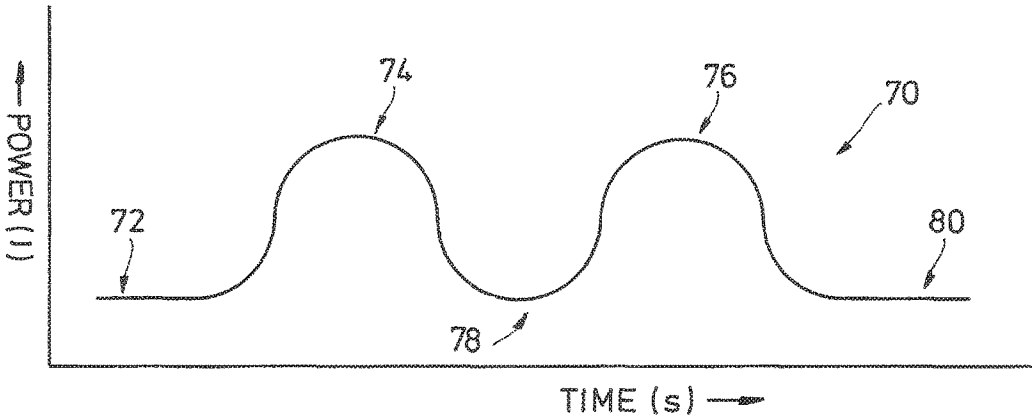
FIG. 5 is an example of a plot that graphically represents a signal recorded by a proximity sensor on the ESP system of FIG. 2.

FIG. 5 shows in graphical form one example of a plot 70 that illustrates Time (s) versus Power (J) of signals received from one or more of the proximity sensors 54, 56. Plot 70 though may have other units for comparing the magnitude of the signal from the sensors. Here, a portion 72 of plot 70 is at a baseline value of power and indicating when a particular sensor is not sensing another sensor or a mass of conductive material. As can be seen, the plot 70 transitions to a greater power over time up to a local maximum 74, which can indicate the particular sensor being proximate or adjacent to another sensor or a mass of conductive metal. Spaced apart from local maximum 74 is another local maximum 76 indicating proximity of a sensor with yet another sensor or mass of material. Between the local maximums 74, 76 is a local minimum 78 which shows a magnitude of power roughly that of the magnitude of the portion 72. As such, it can be inferred at that time the sensor is spaced away from another sensor or a mass of material (e.g. metal). Over time the magnitude of the plot 70 diminishes to portion 80, indicating the sensor is axially spaced away from sensor or mass. Knowing the positions of the masses of metal, such as the stinger 28, receptacle 22, or the positions of other sensors, then correlating the values of signal power as shown in FIG. 5, such as the number of magnetic signal strength increases and decreases, very discrete estimates of the relative positions of the stinger 28 and receptacle 22 (FIG. 1) can be estimated from the plot 70.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. For example, the permanent or electromagnets described above can have different strengths, thereby providing a signature which can better provide discrete relative positions of the receptacle 22 and stinger 28 when the magnet is being sensed by a sensor. The ESP system 10 can be operated and deployed without a rig. These and other similar modifications will readily suggest themselves to those skilled in the art, and are intended to be encompassed within the spirit of the present invention disclosed herein and the scope of the appended claims.

What is claimed is:

1. A system for producing fluid from a subterranean wellbore comprising:

an electrical submersible pump ("ESP") system comprising a pump, a motor mechanically coupled with the pump, a monitoring sub, and a stinger projecting axially away from the pump;

a receptacle comprising an annular member mounted to a tubular disposed in the wellbore;

a first sensor coupled with the stinger that is in communication with a controller; and a second sensor coupled with the receptacle that is in communication with the controller and in selective communication with the first sensor when proximate the first sensor, so that when the first and second sensors are proximate one another, one or both of the first and second sensors selectively emit signals representing distances between the stinger and receptacle.

2. The system of claim 1, wherein the signals representing distances between the first and second sensors provides an estimate of a distance between the stinger and receptacle.

3. The system of claim 1, wherein the first sensor comprises a multiplicity of sensors that are each in communication with the controller and the second sensor.

4. The system of claim 3, wherein the multiplicity of sensors are spaced equidistance apart.

5. The system of claim 3, wherein the multiplicity of sensors are spaced apart at different distances.

6. The system of claim 5, further comprising a reel, a cable on the reel having an end coupled to the ESP, and a load sensor on the reel that senses tension in the cable and that is in communication with the controller.

7. The system of claim 1, wherein the first and second sensors are each selected from the group consisting of an optical sensor, an acoustic sensor, an electromagnetic sensor, a permanent magnet, and combinations thereof.

8. The system of claim 1, further comprising a seal that defines a flow and pressure barrier in an annulus between the stinger and receptacle and that is formed when the stinger inserts into the receptacle.

9. The system of claim 1, wherein the signals representing distances between the first and second sensors comprises a first signal, wherein the first and second sensors emit a second signal when the stinger is landed in the receptacle, and wherein the first signal is distinguishable from the second signal.

10. The system of claim 1, wherein the second sensor comprises a multiplicity of sensors that are each in communication with the controller and the first sensor, and that are spaced axially away from one another.

11. A method for producing fluid from a subterranean wellbore comprising:

deploying in the wellbore an electrical submersible pumping ("ESP") system that comprises a motor that is coupled to a pump;

lowering the ESP system within the wellbore and towards a receptacle;

providing an indication that the ESP system has landed in the receptacle based on a signal received from a sensor that senses a distance between a location on the ESP system and a location in the receptacle;

pressurizing fluid within the wellbore by operating the pump when the distance between the end of the ESP system and receptacle is within a designated distance; and monitoring another signal from the sensor when the pump is operating to detect relative movement of the ESP system and receptacle to provide an indication if the ESP system is properly or improperly seated within receptacle.

12. The method of claim 11, wherein the location on the ESP system is on a stinger that projects axially away from the pump.

13. The method of claim 12, wherein the sensor comprises a first sensor and is coupled with the ESP system, wherein a second sensor is coupled with the receptacle, and wherein the first and second sensors are each in communication with a controller and with one another.

14. The method of claim 13, wherein sensing a distance between a location on the ESP system and a location in the receptacle comprises monitoring a signals from one or both of the first and second sensors that provides an identification of the distance between the first and second sensors, and where the distance comprises a range of distances.

15. The method of claim 13, wherein sensing a distance between a location on the ESP system and a location in the receptacle comprises monitoring a signals from one or both of the first and second sensors, wherein the signal is based on detecting a presence of one of the receptacle or the ESP system.

16. The method of claim 13, wherein the first and second sensors each comprise a multiplicity of sensors.

17. The method of claim 11, further comprising sensing a thrust created by the ESP system based on the step of sensing a distance between a location on the ESP system and a location in the receptacle.

18. The method of claim 11, further comprising monitoring stress in a wireline used for deploying the ESP system based on the step of sensing a distance between a location on the ESP system and a location in the receptacle.

19. A method for producing fluid from a subterranean wellbore comprising:

monitoring a first sensor that is coupled with a stinger disposed on an ESP system being inserted into a receptacle disposed within the wellbore;

monitoring a second sensor that is coupled with the receptacle and that is in communication with the first sensor;

confirming the stinger has landed into receptacle so that a fluid seal is formed between stinger and receptacle by receiving a signal from one of the first or second sensors indicating that the stinger has been inserted into the receptacle a designated distance; and pressurizing fluid with the ESP system and directing the pressurized fluid to an outlet of the wellbore.

20. The method of claim 19, wherein distances between the first and second sensors are communicated between the first and second sensors and communicated to a controller from a one of the first or second sensors.

* * * * *